US010661563B2

(12) United States Patent
Yamauchi et al.

(10) Patent No.: US 10,661,563 B2
(45) Date of Patent: May 26, 2020

(54) LIQUID EJECTION HEAD

(71) Applicant: CANON KABUSHIKI KAISHA, Tokyo (JP)

(72) Inventors: Sachiko Yamauchi, Yokohama (JP); Isao Imamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/001,806

(22) Filed: Jun. 6, 2018

(65) Prior Publication Data

US 2018/0354264 A1 Dec. 13, 2018

(30) Foreign Application Priority Data

Jun. 9, 2017 (JP) ..... 2017-114249
Mar. 14, 2018 (JP) ..... 2018-047024

(51) Int. Cl.
*B41J 2/14* (2006.01)
*B05D 7/16* (2006.01)
*B41J 2/16* (2006.01)

(52) U.S. Cl.
CPC ..... *B41J 2/14* (2013.01); *B05D 7/16* (2013.01); *B41J 2/16* (2013.01); *B41J 2002/14362* (2013.01); *B41J 2202/20* (2013.01)

(58) Field of Classification Search
CPC ..... B41J 2/14; B41J 2/16; B41J 2/1637; B41J 2/1623; B41J 2202/21; B41J 2002/14362; B41J 2202/20; B41J 2202/03; B05D 7/16
See application file for complete search history.

(56) References Cited

U.S. PATENT DOCUMENTS 5,650,805 A * 7/1997 Shimomura ..... C08L 101/10 347/20
6,168,253 B1 * 1/2001 Miyagawa ..... B41J 2/14024 347/20
6,391,140 B1 5/2002 Patil
2005/0078143 A1 4/2005 Shimomura et al.
2007/0236542 A1 10/2007 Graham et al.
2011/0181665 A1 7/2011 Takaoka et al.
2013/0201249 A1 8/2013 Hamada et al.
2017/0036444 A1 2/2017 Kihara

FOREIGN PATENT DOCUMENTS

CN 102146275 A 8/2011
CN 102402160 A 4/2012
CN 103073843 A 5/2013
CN 103858180 A 6/2014
EP 0648605 A2 4/1995
EP 2586808 A1 5/2013
(Continued)

*Primary Examiner* — Geoffrey S Mruk
(74) *Attorney, Agent, or Firm* — Canon U.S.A. Inc., IP Division

(57) ABSTRACT

A liquid ejection head includes a substrate having an ejection opening through which a liquid is ejected, a recessed member having a wall defining a recess in which the substrate is disposed away from the wall with a gap therebetween, and a sealing member filling the gap. The sealing member includes a cured product of a composition containing a first polyol compound, an isocyanate compound having an isocyanate group, and a second polyol compound that is more reactive with the isocyanate group than the first polyol compound.

20 Claims, 5 Drawing Sheets

(56) References Cited

FOREIGN PATENT DOCUMENTS

| | | | |
|---|---|---|---|
| EP | 2767983 | A1 | 8/2014 |
| JP | 2904629 | B2 | 6/1999 |
| JP | 5780917 | B2 | 9/2015 |
| TW | 201527423 | A | 7/2015 |
| WO | 2015104918 | A1 | 7/2015 |
| WO | 2017094358 | A1 | 6/2017 |

* cited by examiner

LIQUID EJECTION HEAD

BACKGROUND OF THE INVENTION

Field of the Invention

The present disclosure relates to a liquid ejection head including a sealing member filling a gap between components thereof.

Description of the Related Art

A liquid ejection head includes a plurality of energy generating elements configured to apply energy to a liquid, thereby ejecting the liquid through a plurality of ejection openings. One type of the liquid ejection heads is an ink jet recording head intended to be mounted in an ink jet recording apparatus configured to eject ink onto recording media for recording.

An ink jet recording head includes a variety of components including a substrate having ejection openings through which ink is ejected, and electrical wiring lines intended for use to electrically control the ejection of the ink. After such components are assembled together, the gaps between the components are filled with a sealing member to prevent the ink from flowing into the gaps.

Japanese Patent No. 5780917 discloses one of the sealing members that contains a dicyclopentadiene-type epoxy resin, a hydrogenated bisphenol A epoxy resin, and a photo-induced cationic polymerization initiator.

Unfortunately, if a sealing member formed by polymerization induced by irradiation with light is used, the thickness of the sealing member is limited because light transmission is restricted to a specific depth. Recent ink jet recording heads have a high-density complex structure that enables high-definition images to be printed or recorded more rapidly. In particular, the type called a line head, which is configured to eject ink from a fixed position onto paper or any other medium being fed, tends to be larger and more complex. Accordingly, gaps that should be filled with the sealing member are deep. The sealing member formed by polymerization induced by irradiation with light is often not suitable.

A sealing member that can be cured without using a polymerization initiator is disclosed in Japanese Patent No. 2904629. This sealing member contains a urethane resin produced by a reaction of a polyol compound with an isocyanate compound.

Various functions are required for the surface of the ink jet recording head at which ejection openings are formed. For example, the sealing member is to come into contact with ink, and accordingly, the surface at which the ejection openings are formed is required to be resistant to ink. If electrical wiring is sealed, the sealing member must to insulative. An ink jet recording apparatus has a rubber blade configured to wipe and remove ink droplets attached to the surface of the ink jet recording head at which the ejection openings are formed. Accordingly, the sealing member is also required to be resistant to the action of the blade.

According to some studies by the present inventors, however, the urethane resin produced by a reaction of a common polyol compound with an isocyanate compound as disclosed in Japanese Patent No. 2904629 is not sufficiently resistant to ink. Also, the insulation of the urethane resin is low. In addition, the urethane resin is soft and less elastic; hence it has poor resistance to the action of the blade.

SUMMARY OF THE INVENTION

According to an aspect of the present disclosure, there is provided a liquid ejection head including a substrate having an ejection opening through which a liquid is ejected, and a recessed member having a wall defining a recess in which the substrate is disposed away from the wall with a gap therebetween. The liquid ejection head also includes a sealing member filling the gap. The sealing member includes a cured product of a composition containing a first polyol compound, an isocyanate compound having an isocyanate group, and a second polyol compound that is more reactive with the isocyanate group than the first polyol compound.

Further features of the present disclosure will become apparent from the following description of exemplary embodiments with reference to the attached drawings.

DESCRIPTION OF THE EMBODIMENTS

The present disclosure provides a liquid ejection head sealed with an insulating sealing member that is resistant to ink and the action of the blade.

Some of the embodiments of the present disclosure will now be described in detail.

Liquid Ejection Head

Figure 1:
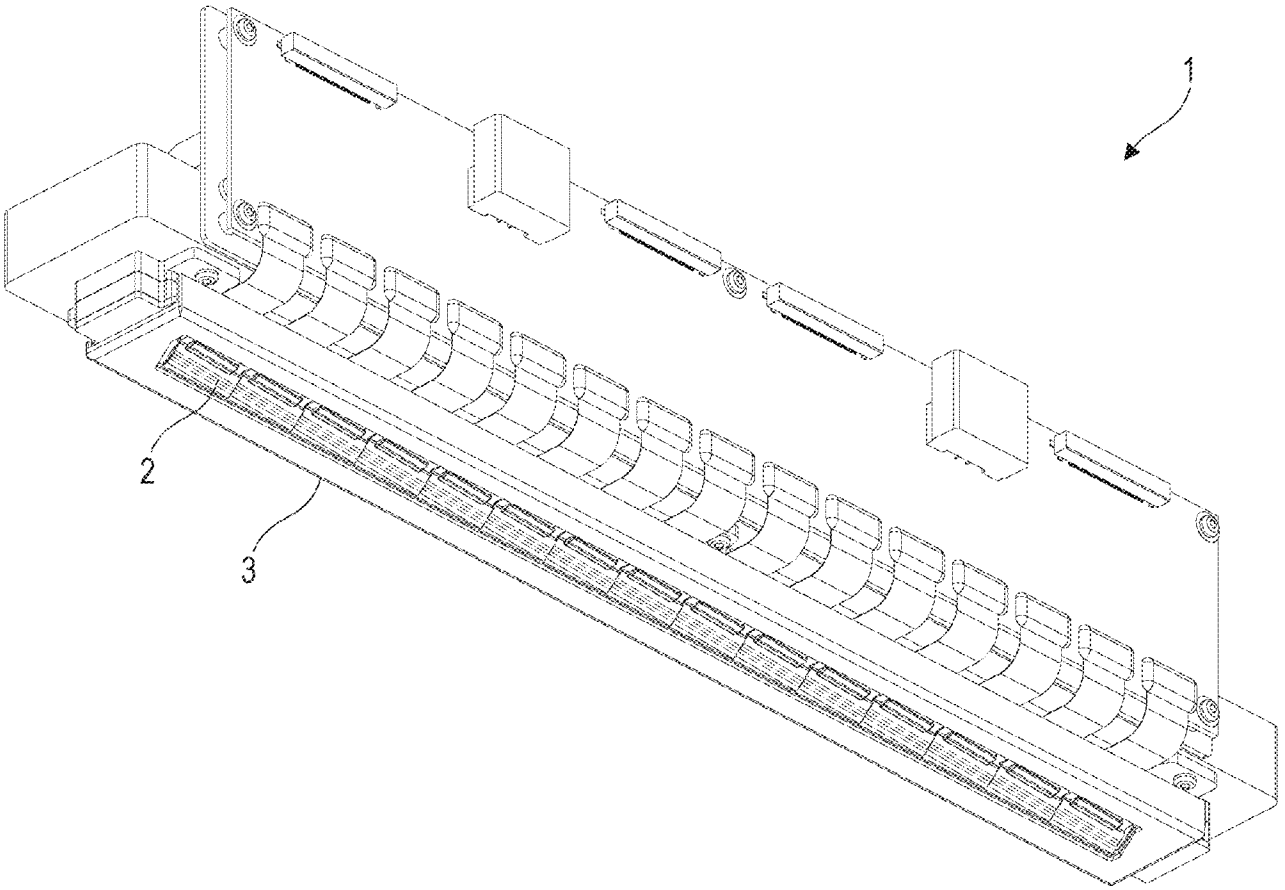
FIG. 1 is a perspective view of a liquid ejection head according to an embodiment of the present disclosure.
Figure 2A:
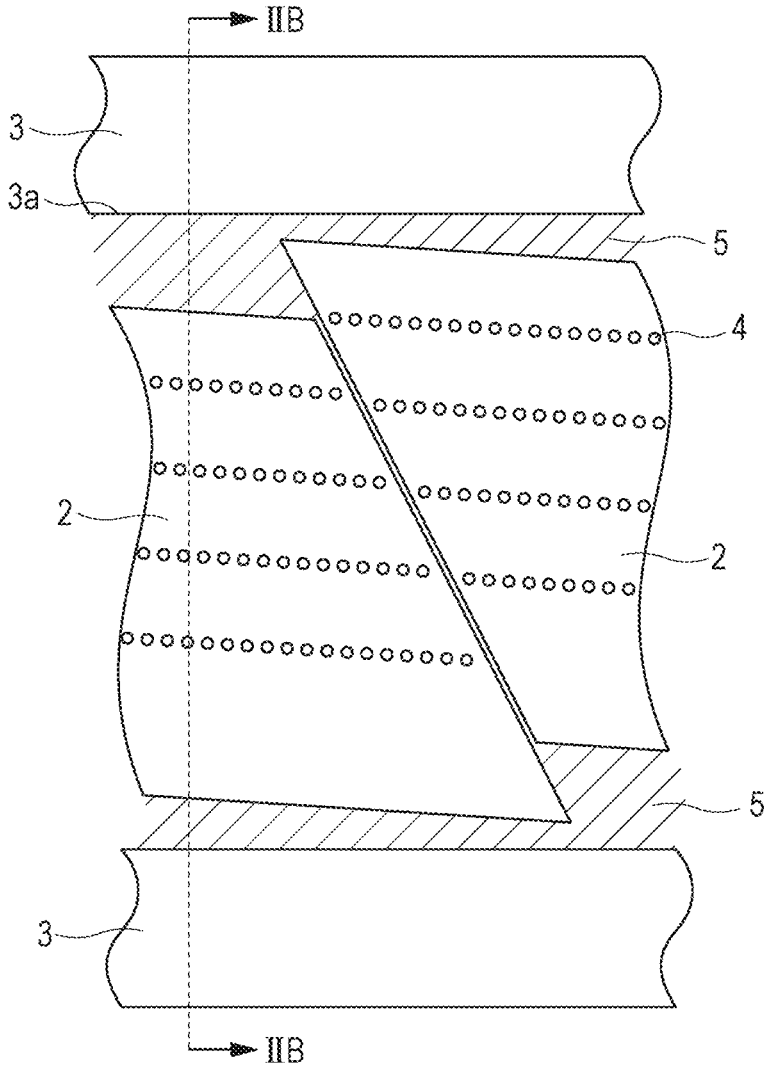
FIG. 2A is an enlarged partial view of a liquid ejection head according to an embodiment of the present disclosure.
Figure 2B:
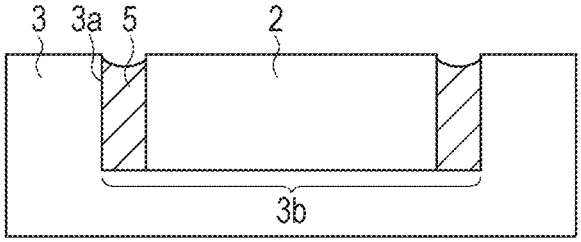
FIG. 2B is a sectional view of the liquid ejection head taken along line IIB-IIB in FIG. 2A.

The liquid ejection head of the present disclosure will first be described with reference to some of the drawings. FIG. 1 is a perspective view of a liquid ejection head according to an embodiment of the present disclosure. FIG. 2A is an enlarged partial view of the liquid ejection head, and FIG. 2B is a sectional view of the liquid ejection head taken along line IIB-IIB shown in FIG. 2A.

The liquid ejection head 1 includes substrates 2 and a member 3 supporting the substrates 2. Each substrate 2 has ejection openings 4 through which ink is ejected, energy generating elements (not shown) configured to generate energy for ejecting the ink, and electrical circuit element (not shown) configured to control the energy generating elements.

The liquid ejection head 1 is what is called a line head, which enables high-speed recording. A line head is a type of liquid ejection head having a width, across the width of the recording medium, larger than or equal to the width of the recording medium and includes a plurality of substrates 2 that are aligned linearly in the width direction of the recording medium. The plurality of substrates 2 are disposed on the liquid ejection head 1 to form a continuously aligned line longer than or equal to the width of the recording medium so that recording can be performed by passing the recording medium once under the stationary ejection head 1. In the present embodiment, the width of the recording medium is assumed to be the distance of the shorter sides of the four sides of a A4 paper sheet.

The linearly aligned substrates 2 are disposed in a recess 3*a* formed in the member 3. The substrates 2 are each disposed away from the wall 3*b* of the recess 3*a* of the member 3 with a gap therebetween when viewed from the surface of the liquid ejection head 1 at which the ejection openings are formed. The substrates 2 may also be disposed with gaps between each other. The gaps between the substrates 2 and between the substrates 2 and the wall 3*b* are filled with a sealing member 5. The sealing member 5 is formed by pouring (applying) a sealing member composition into the gaps between the substrates 2 and the wall 3*b* defining the recess 3*a* of the recessed member 3 and curing the composition.

Sealing Member Composition

The constituents of the sealing member composition will now be described. The sealing member composition contains a first polyol compound, an isocyanate compound having an isocyanate group, and a second polyol compound that is more reactive with the isocyanate group than the first polyol compound. The sealing member composition is cured into a urethane resin by a reaction of the hydroxy groups of the polyol compound with the isocyanate group of the isocyanate compound to form urethane linkages.

First Polyol Compound

In some embodiments, the first polyol compound may contain two hydroxy groups in view of the reactivity with the isocyanate compound.

In some embodiments, the first polyol compound has four or more unsaturated carbon-carbon bonds. In an embodiment, the first polyol compound may have a polyolefin skeleton. The unsaturated carbon-carbon bond can enhance the water resistance of the resulting urethane resin and functions to reduce the amount of ink absorbed by the urethane resin. Also, the unsaturated carbon-carbon bond functions to increase insulation and rubber elasticity.

Exemplary groups having the unsaturated carbon-carbon bond include alkenylene groups having a carbon number of 2 to 6 and alkynylene groups having a carbon number of 2 to 6. Exemplary alkenylene groups include ethenylene, propenylene, 1-butenylene, 2-butenylene, butadienylene, and isoprenylene. One example of the alkynylene groups may be isobutynylene. In some embodiments, the first polyol compound may have two or more unsaturated carbon-carbon bonds in the molecule thereof.

In some embodiments, the first polyol compound may be polybutadiene diol represented by the following formula (1):

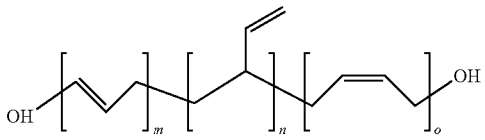

In formula (1), m, n, and o each represent an integer of 1 or more.

Isocyanate Compound

The isocyanate compound has an isocyanate group. The isocyanate group reacts with any of the hydroxy groups of the first polyol compound to form a urethane linkage.

In some embodiments, the isocyanate compound has two or more isocyanate groups in view of reactivity with the first polyol compound.

Examples of the isocyanate compound include tolylene diisocyanate, diphenylmethane diisocyanate, hexamethylene diisocyanate, isophorone diisocyanate, xylylene diisocyanate, hydrogenated xylylene diisocyanate, naphthalene diisocyanate, and norbornene diisocyanate.

In some embodiments, the isocyanate compound may be 4,4'-diphenylmethane diisocyanate represented by the following formula (2) or a polymethylene phenyl polyisocyanate represented by the following formula (3):

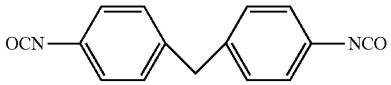

(2)

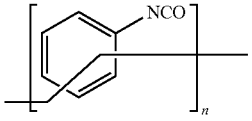

(3)

In formula (3), n represents an integer of 1 or more.

Second Polyol Compound

The second polyol compound is more reactive with the isocyanate group of the isocyanate compound than the first polyol compound.

Although the first polyol compound is also reactive with the isocyanate group of the isocyanate compound, the reactivity of the first polyol compound alone is low in some cases. Accordingly, in order to enhance reactivity with the isocyanate group, a polyol compound more reactive than the first polyol compound with the isocyanate group of the isocyanate compound is added as the second polyol compound. A high reactivity of the second polyol compound with the isocyanate group of the isocyanate compound suggests that the second polyol compound has a solubility parameter closer than the first polyol compound to the solubility parameter of the isocyanate compound.

Thus, the combined use of the first polyol compound and the second polyol compound enables a sea-island structure to be formed at the surface of the sealing member. The sea-island structure, which is also called a matrix-domain structure, includes a continuous phase forming a sea-like portion and a discontinuous phase forming island-like portions. Probably, the sea-island structure is formed by a phase separation between the first polyol compound and the second polyol compound while the polyol compounds are reacting to form a urethane resin. In general, a sea-island structure (phase separation) results from a difference in hydrophilicity (or hydrophobicity) or polarity between compounds. For example, if a relatively hydrophilic polyol compound and a relatively hydrophobic polyol compound are mixed, the hydrophilic polyol molecules are likely to aggregate together with time due to their affinity, and, similarly, the hydrophobic polyol molecules are likely to aggregate together. These molecules first form aggregates locally and, finally, phase separation occurs. In view of the reactivity and from the viewpoint of forming a sea-island structure, the first polyol compound has a lower solubility parameter than the second polyol compound.

In some embodiments, the second polyol compound may have a smaller number of unsaturated carbon-carbon bonds than the first polyol compound in the molecule thereof or have no polyolefin skeleton.

Also, the second polyol compound may be more hydrophilic than the first polyol compound. In some embodiments, the second polyol compound may have an ester skeleton, a ketone skeleton, or an amine skeleton.

Examples of the second polyol compound include polyester polyol, polyether polyol, polycarbonate polyol, polyester polycarbonate polyol, and castor oil-based polyol. In some embodiments, a castor oil-based polyol may be used. The castor oil-based polyol may be a compound represented by the following formula (4):

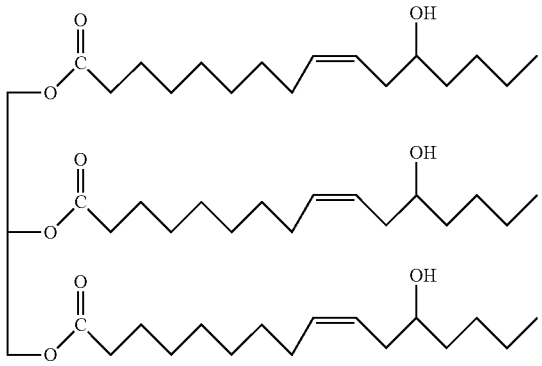

In the present disclosure, the sealing member has a sea-island structure at the surface thereof. The sea-island structure will now be described in detail.

A sea-island structure having a height difference between the sea-like portion and the island-like portions is effective in reducing the contact area of the sealing member with the blade when the liquid ejection head is restored by suction with the blade. When the height difference between the sea-like portion and the island-like portions exceeds 100 nm, the contact of the urethane resin with the blade is further reduced, preventing the sealing member from wearing down the blade. However, an excessive height difference may result in reduced suction pressure for suction restoring. Accordingly, in some embodiments, the height difference may be 1000 nm or less, for example, 500 nm or less. The heights of the sea-like portion and the island-like portions are each determined by averaging the heights measured at 20 randomly selected points. In some embodiments, the sea-like portion of the sea-island structure having a height difference between the sea-like portion and the island-like portions may be softer than the island-like portions. When a blade rubs the sealing member, the blade strikes the relatively high and hard island-like portions, so that most of the force of the moving blade is applied to the island-like portion. The force applied to the island-like portion is absorbed by the relatively soft sea-like portion. Thus, the sealing member is prevented from wearing down.

In some embodiments, the sea-like portion may be made of the first polyol compound. The first polyol compound forming the sea-like portion may have a chemical structure that can enhance rubber elasticity. Specifically, the first polyol compound may have four or more unsaturated carbon-carbon bonds. More specifically, it may be a polyol compound having an olefin skeleton.

In some embodiments, the island-like portions may be made of the second polyol compound. The second polyol compound forming the island-like portions, in contrast, may have a smaller number of unsaturated carbon-carbon bonds in the molecule than the first polyol compound forming the sea-like portion. More specifically, in some embodiments, the second polyol compound forming the island-like portions may be a polyol compound in which the number of unsaturated carbon-carbon bonds is 3 or less or a polyol compound having no olefin skeleton. From the viewpoint of increasing the density of urethane linkages for a high hardness, the second polyol compound may have a lower molecular weight and a larger number of hydroxy groups than the first polyol compound.

The combination of the first polyol compound and the second polyol compound may be as described below in view of the solubility parameters and the harness or softness of the sea-island structure. In an embodiment, the first polyol compound is a polybutadiene diol, and the second polyol compound is castor oil. In another embodiment, the first polyol compound is a polybutadiene diol, and the second polyol compound is triethanolamine.

The area ratio between the sea-like portion and the island-like portions depends on the ratio between the polyol compound forming the sea-like portion and the polyol compound forming the island-like portions in the composition. In some embodiments, the sea-like portion is softer and has a larger area than the island portions. Accordingly, in these embodiments, the proportion in weight of the first polyol compound in the composition is higher than that of the second polyol compound.

The size of the island-like portions is a factor in the period of time from mixing the polyol compounds and the isocyanate compound to pouring the mixture or composition into the gaps. On mixing the polyol compounds and the isocyanate compound, the phase separation of the polyol compounds as well as a curing reaction starts. During the period of time from the mixing to the pouring, the curing reaction proceeds to increase the viscosity of the mixture, and the phase separation between the polyol compounds continues. When the mixture is poured into the gaps, the mixture is slightly agitated, and the phase separation collapses.

The shorter the period of time from the mixing to the pouring, the lower the viscosity of the mixture. Accordingly, even if the phase separation collapses in response to the pouring, the mixture is likely to separate again into phases immediately after being poured, thus forming large island-like portions. In contrast, the longer the period of time from the mixing to the pouring, the higher the viscosity of the mixture. Accordingly, the mixture is not likely to separate into phases after being poured. Accordingly, the island-like portions tend to become small.

Catalyst

The sealing member composition may contain a catalyst to control the reaction of the polyol compounds with the isocyanate compound. The catalyst may be an amine compound or a metal-based catalyst.

Examples of the amine compound include triethylenediamine (TED), 1,1,3,3-tetramethyleneguanidine (TMG), and N,N,N',N'-tetramethyl-1,6-hexanediamine (TMHMDA). Examples of the metal-based catalyst include organic tin catalysts, such as dibutyltin dilaurate, dioctyltin dilaurate, and stannous octoate; and acetylacetonate complexes of transition metals, such as titanium, iron, copper, zirconium, nickel, cobalt, and manganese.

Filler

The sealing member composition may further contain a filler from the viewpoint of reducing cure shrinkage of the resin and securing flexibility after curing. Examples of the filler include silica, carbon black, titanium oxide, kaolin, clay, and calcium carbonate. In some embodiments, fused silica may be used as the filler. The average particle size (volume average particle size) of the filler may be in the range of 10 nm to 200 μm.

Since the fluidity of compositions containing a filler is low, it becomes difficult for the sealing member composition to flow in the gaps between the components when the sealing member composition is poured into the gaps or takes a long time to pour the composition. In the manufacture of a large liquid ejection head such as a line head, it is important that the sealing member composition flow freely. Accordingly, it is beneficial to minimize the filler content. The filler content in the sealing member composition may be one-third or less of the total mass of the composition, and, for example, the filler content may be one-tenth or less of the total mass of the composition.

Plasticizer

The sealing member composition may contain a plasticizer. Any of the compounds unreactive with the isocyanate group may be used as the plasticizer. Examples of the plasticizer include tetrahydrophthalic acid esters, azelaic acid esters, maleic acid esters, phthalic acid esters, trimellitic acid esters, and adipic acid esters.

Polymerization Initiator

The reaction between the polyol compounds with the isocyanate compound can proceed without a polymerization initiator. The polymerization initiator content in the sealing member composition therefore may be 0.1% by mass or less, such as 0.01% by mass or less. In an embodiment, the sealing member composition may not contain any polymerization initiator.

Although the curing reaction of the sealing member composition can proceed without heating, the composition may be heated to 40° C. to 50° C. to promote the curing reaction. Since the sealing member composition can be cured at a relatively low temperature in the range of 0° C. to 50° C., problems in manufacture, such as deformation or cracks of the substrates resulting from a difference in the linear expansion coefficient between the substrates and the sealing member, can be avoided.

Method for Manufacturing Liquid Ejection Head

In the manufacture of the liquid ejection head, the sealing member composition is first prepared by mixing the ingredients. The prepared composition is applied into the gaps between the wall of the recess and the substrates. The applied composition is cured as described above. The composition is thus formed into a sealing member. The period of time from mixing the ingredients to applying the composition may be 30 minutes or less.

EXAMPLES

The subject matter of the present disclosure will be further described with reference to the following Examples.

Evaluation 1

Preparation of Sealing Member Compositions

Composition Nos. 1 to 3 were prepared by mixing the ingredients shown in Table 1 with a vacuum stirring defoaming mixer. The values in Table 1 are each represented by parts by mass.

TABLE 1

| | No. 1 | No. 2 | No. 3 |
|---|---|---|---|
| Polybutadiene diol (first polyol) | 3.08 | 3.08 | — |
| Castor oil-based polyol (second polyol) | 2.52 | 2.52 | 4.00 |
| 4,4'-Diphenylmethane diisocyanate | 1.00 | 1.00 | 1.00 |
| Polymethylene polyphenyl polyisocyanate | 1.92 | 1.92 | 1.00 |
| Diisodecyl phthalate | 0.92 | 0.92 | — |
| Dioctyltin dilaurate (reaction initiator) | 0.01 | 0.01 | 0.01 |
| Fused silica (filler) | — | 2.92 | — |

The following first and second polyol compounds were used. Also, a fused silica FB-940 produced by Denka was used.

First Polyol Compound

Polybutadiene diol represented by the following chemical formula (produced by Sigma-Aldrich, number average molecular weight: 1200):

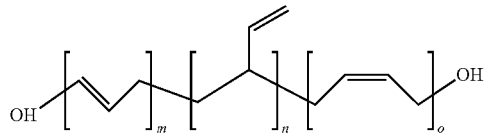

Second Polyol Compound

Castor oil-based polyol represented by the following chemical formula (molecular weight: 850):

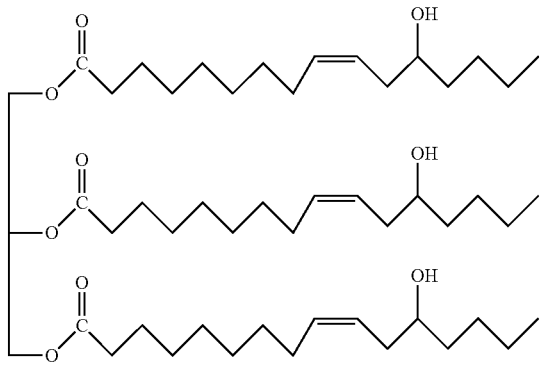

The first polyol compound has 20 unsaturated carbon-carbon bonds per molecular weight of 1000, 1.7 hydroxy groups per molecular weight of 1000, and no functional group (ester in the case of the Examples) per molecular weight of 1000. The second polyol compound has 3.5 unsaturated carbon-carbon bonds per molecular weight of 1000, 3.5 hydroxy groups per molecular weight of 1000, and 3.5 functional groups (ester in the case of the Examples) per molecular weight of 1000.

Examinations of Sealing Members

The sealing members formed of any of the composition Nos. 1 to 3 were examined in terms of the following three: durability, insulation, and resistance to ink. The results are shown in the following Table 2.

Durability

Each of the composition Nos. 1 to 3 prepared was poured into the space in which the sealing member 5 of the liquid ejection head 1 shown in FIG. 1 was to be formed by using a dispenser so as to avoid forming bubbles. Then, the composition was cured by being allowed to stand for one day or more. The thus prepared liquid ejection head was subjected to a durability test by being rubbed 1000 times with a blade (made of acrylonitrile butadiene rubber), and, then, the surface of the sealing member was checked for flaws or wear under an optical microscope.

Insulation

Each of the composition Nos. 1 to 3 was cured by being poured into a mold and allowed to stand at room temperature for one day or more. The resulting cured product was removed from the mold and used as a test sample of the sealing member. The volume resistivity of the test sample was measured.

Resistance to Ink

The test sample was immersed in an ink (water:organic solvent:surfactant=75:25:1) with a mass 20 times that of the test sample and heated at 105° C. for 10 hours. The ink, which was prepared for the test, did not contain any coloring material. The mass of the test sample was measured before and after the heating, and the absorption was calculated with reference to the mass before the heating.

TABLE 2

| | No. 1 (Example) | No. 2 (Example) | No. 3 (Comparative Example) |
|---|---|---|---|
| Flaws or wear | None | None | Observed |
| Volume resistivity (Ω · cm) | $4 \times 10^{14}$ | $6 \times 10^{14}$ | $3 \times 10^{13}$ |
| Ink absorption (%) | 10 | 9 | 14 |

The sealing members formed of either composition No. 1 or No. 2 containing the first polyol compound having a polyolefin skeleton did not suffer from flaws or wear that may be caused by the action of the blade, exhibiting good resistance to the action of the blade. The sealing members formed of either composition No. 1 or No. 2 containing the first polyol compound having a polyolefin skeleton had a higher volume resistivity and accordingly exhibited higher insulation than the sealing member formed of composition No. 3 not containing the first polyol compound. The sealing members formed of either composition No. 1 or No. 2 containing the first polyol compound having a polyolefin skeleton exhibited a lower ink absorption and were more resistant to ink than the sealing member formed of composition No. 3 not containing the first polyol compound.

Evaluation 2

Composition Nos. 4 to 10 were prepared by mixing the ingredients shown in the following Table 3 with a vacuum stirring defoaming mixer. In Table 3, composition No. 7 is the same as composition No. 1 used in Evaluation 1. The polyol compounds, polybutadiene diol and castor oil-based polyol, were mixed with the proportion shown in Table 3. 4,4'-Diphenylmethane diisocyanate, polymethylene polyphenyl polyisocyanate, diisodecyl phthalate, and dioctyltin dilaurate were mixed in the proportion shown in Table 3. The values shown in Table 3 each represent the proportion in terms of weight of the corresponding compound, and the values in the lowest row each represent the weight ratio of the polybutadiene diol to the total of the isocyanate compounds (4,4'-diphenylmethane diisocyanate and polymethylene polyphenyl polyisocyanate).

TABLE 3

| | No. 4 | No. 5 | No. 6 | No. 7 | No. 8 | No. 9 | No. 10 |
|---|---|---|---|---|---|---|---|
| Polybutadiene diol (first polyol) | 3.69 | 3.56 | 3.52 | 3.08 | 2.13 | 2.11 | 2.02 |
| Castor oil-based polyol (second polyol) | 2.83 | 2.73 | 2.70 | 2.52 | 1.33 | 1.32 | 1.27 |
| 4,4'-Diphenylmethane diisocyanate | 1.00 | 1.00 | 1.00 | 1.00 | 1.00 | 1.00 | 1.00 |
| Polymethylene polyphenyl polyisocyanate | 0.96 | 0.96 | 0.96 | 1.92 | 1.92 | 1.92 | 1.92 |
| Diisodecyl phthalate | 0.38 | 0.38 | 0.38 | 0.92 | 1.15 | 1.15 | 1.15 |
| Dioctyltin dilaurate (reaction initiator) | 0.01 | 0.01 | 0.01 | 0.01 | 0.01 | 0.01 | 0.01 |
| Polybutadiene diol/isocyanate compounds (weight ratio) | 1.88 | 1.82 | 1.80 | 1.05 | 0.73 | 0.72 | 0.69 |

The compounds were weighed out in the proportion shown in Table 3 and mixed together with a vacuum stirring defoaming mixer, and the resulting composition Nos. 4 to 10 were each immediately poured into a mold. Then, each composition was cured in the mold by being allowed to stand at 25° C. for one day or more. The resulting cured product was removed from the mold and used as a test sample of the sealing member. Three test samples were formed for each composition.

The test samples were immersed in the same ink as used in the above evaluation and heated at 105° C. for 10 hours. After being heated, the test samples were removed from the ink, and the absorbance of the samples was measured. The wavelength used for this measurement was 200 nm to 400 nm. The sealing member, which mainly contain organic components, shows an absorption at a wavelength of 200 nm to 400 nm. By measuring absorbance at a wavelength in the range of 200 nm to 400 nm, how much the component of the sealing member has migrated to the ink can be estimated.

Figure 3:
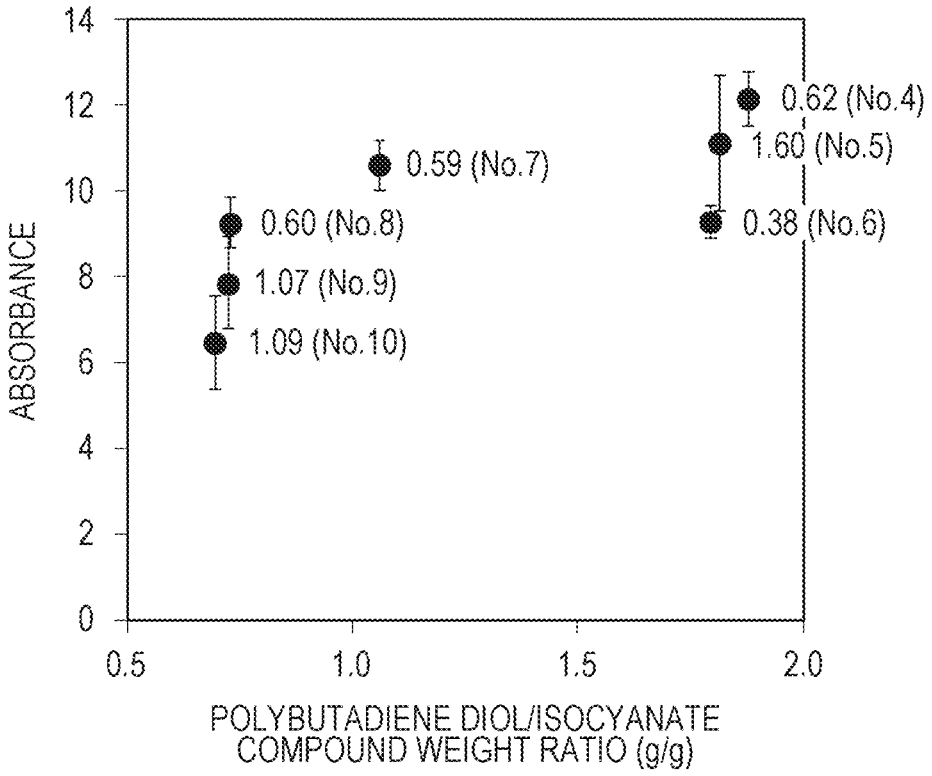
FIG. 3 is a plot illustrating the relationship between the weight ratio of the polybutadiene diol to the isocyanate compound in a composition of a sealing member and the degree of migration of an organic component from the sealing member to ink.

FIG. 3 shows the results of the absorbance measurement. The values in FIG. 3 each represent the standard deviation of the measurements.

The higher the ratio of the first polyol compound having a polyolefin skeleton to the total of the isocyanate compounds, the higher the absorbance. The sealing member composition is cured into a urethane resin by a 1:1 reaction of the hydroxy groups of the polyol compound with the isocyanate group of the isocyanate compound to from urethane linkages. The reason why the absorbance increases as the ratio of the first polyol compound having a polyolefin skeleton to the total of the isocyanate compounds is increased is probably that an excess organic component having no urethane linkage is increased. The organic component that has migrated from the sealing member to ink may clog the ejection openings. Therefore, a composition from which the organic component does not migrate much is desirable as the material of the sealing member.

When the ratio of the first polyol compound having a polyolefin skeleton to the total of the isocyanate compounds was too high or too low, the absorbance varied widely. A large deviation implies that the amount of unreacted organic component in the resulting urethane resin varies widely even though the ratio between the isocyanate compounds and the polyol compound having a polyolefin skeleton is constant. If either the hydroxy group or the isocyanate group is excessive in amount, the probability of uneven growth of polymer network structure increases. Accordingly, the possibility of resulting in a non-uniform urethane resin increases. It is assumed that the reason of wide variation in absorbance is uneven growth of the network structure in the urethane resin and variation in amount of migrated organic component.

The test results shown in Table 3 suggest that the weight ratio of the polybutadiene diol to the isocyanate compounds of composition Nos. 6, 7 and 8, that is, a ratio from 0.73 to 1.80, is suitable for use in ink jet recording heads.

Evaluation 3

The urethane resin, that is, the sealing member, was subjected to examinations for estimating the surface profile and the resistance to the action of the blade by varying the period of time from mixing the ingredients to applying the composition.

The ingredients of composition No. 7 shown in Table 3 were mixed with a vacuum stirring defoaming mixer. The resulting mixture was allowed to stand at a room temperature of 25° C. for a predetermined time and was then cured in a mold by being allowed to stand at room temperature for one day or more.

The linear surface roughness (total height of the roughness profile Rt) of the resulting cured product was measured as the surface profile with a laser microscope VK 9700 (manufacture by Keyence), and the sea-like portion and the island-like portions were observed with a microscope manipulator. For the resistance to the action of the blade, the surface of the cured product was rubbed with a blade Millathane E34 (manufactured by TSE Industries) and checked for wear under a microscope.

Figure 4A:
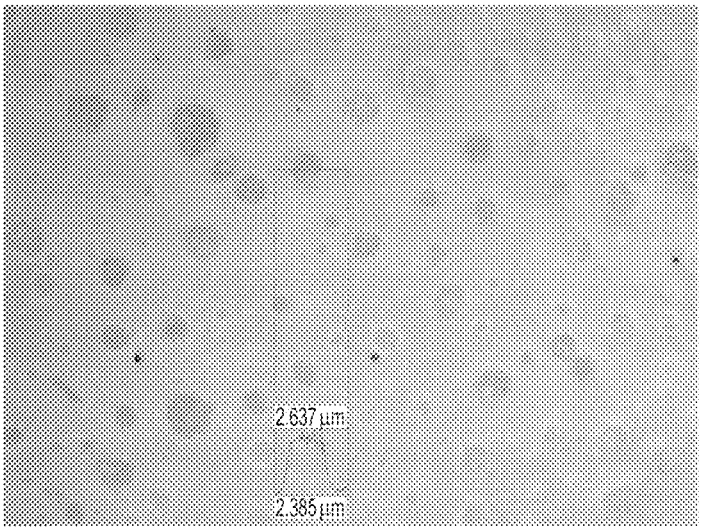
FIG. 4A is a micrograph of a cured product of a composition.
Figure 4B:
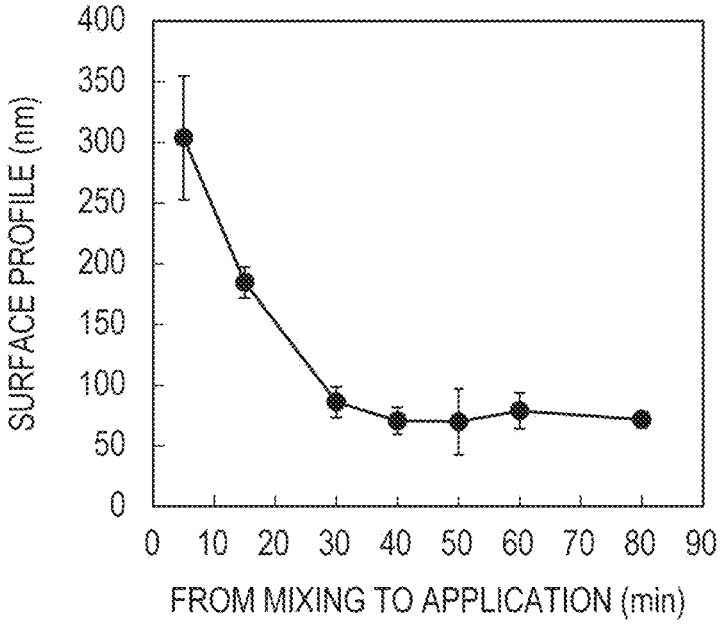
FIG. 4B is a plot illustrating changes with time in surface profile of the cured product.

FIG. 4A shows a micrograph of the cured product of the composition applied 5 minutes after the mixing, observed under the laser microscope. The surface of the cured product showed an appear representing a sea-island structure. The island-like portions had a diameter of about several tens of micrometers. When touched with the microscope manipulator, the island-like portions were relatively hard, while the sea-like portions were relatively soft. The total height of the roughness profile measured between the sea-like portion and one of the island-like portions shown in FIG. 4A was 252 nm. The same measurement was performed at several points, and the surface profile was thus estimated from the measurement results. FIG. 4B shows the relationship between the period of time from mixing the ingredients to applying the composition and the surface profile. The shorter the period of time, the larger the height difference or roughness. When the period of time from the mixing to the application exceeded 30 minutes, the height difference at the surface decreased to about less than 100 nm without varying with time. This suggests that it is beneficial to set the period of time from the mixing to the application to 30 minutes or less.

Figure 5A:
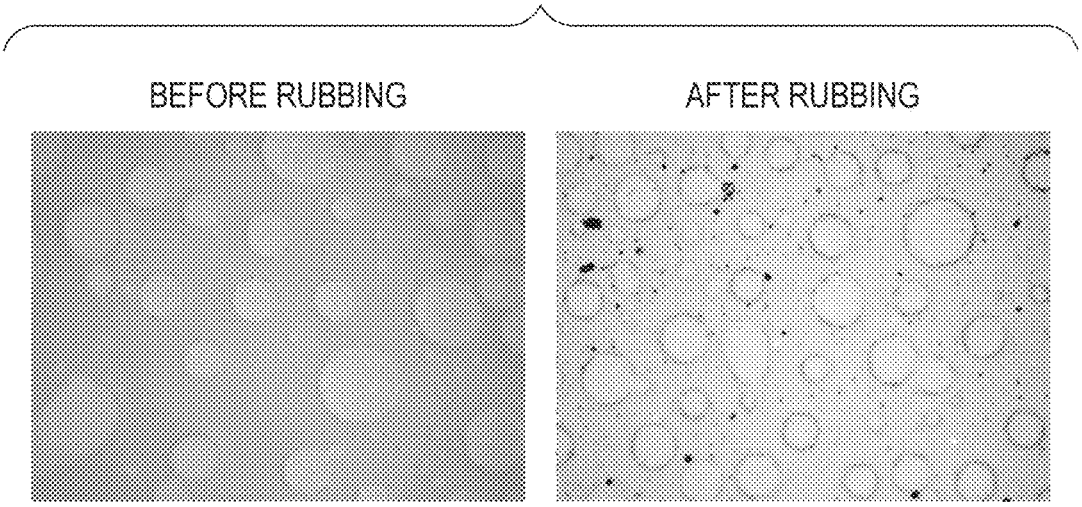
FIG. 5A is a representation illustrating degrees of wear of the cured product.
Figure 5B:
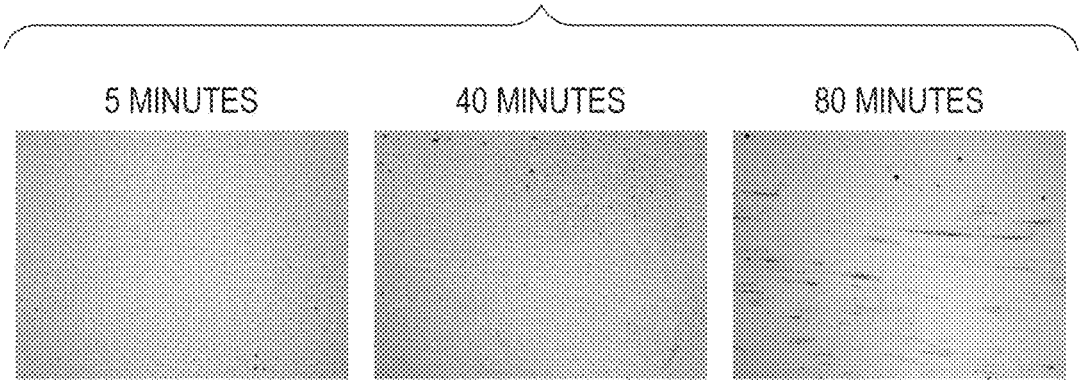
FIG. 5B is a representation of changes in degree of wear of the cured product with time.

Subsequently, the resistance to the action of the blade was estimated. FIG. 5A shows a micrograph (high magnification) of the surface of the cured product before and after rubbing with a blade. When rubbed with the blade, the cured product was worn down at the sea-like portion of the sea-island structure. FIG. 5B shows micrographs (low magnification) of the surfaces, rubbed with a blade, of the cured products formed by taking a varied time from the mixing to the application. The longer the period of time, the more the cured product wore down. The results of the rubbing with the blade are shown in the following Table 4.

TABLE 4

| | Time | | | | | | |
|---|---|---|---|---|---|---|---|
| | 5 min | 15 min | 30 min | 40 min | 50 min | 60 min | 80 min |
| Wear | Very little | Very little | Little | Little | Little | Fair | Fair |

As the period of time from the mixing to the application is shorter, the difference in height between the sea-like portion and the island-like portions of the sea-island structure increased. Probably, the contact area between the cured product and the blade was thus reduced, accordingly reducing wear.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-114249 filed Jun. 9, 2017 and No. 2018-047024 filed Mar. 14, 2018, which are hereby incorporated by reference herein in their entirety.

What is claimed is:

1. A liquid ejection head comprising:

a plurality of linearly aligned substrates, each having an ejection opening through which a liquid is ejected;

a recessed member supporting the plurality of linearly aligned substrates, the recessed member having a wall defining a recess in which the plurality of linearly aligned substrates are disposed away from the wall with a gap therebetween; and a sealing member filling the gap, wherein the sealing member includes a cured product of a composition containing a first polyol compound, an isocyanate compound having an isocyanate group, and a second polyol compound that is more reactive with the isocyanate group than the first polyol compound.

2. The liquid ejection head according to claim 1, wherein the first polyol compound has at least four unsaturated carbon-carbon bonds.

3. The liquid ejection head according to claim 1, wherein the first polyol compound is a polybutadiene diol.

4. The liquid ejection head according to claim 3, wherein the weight ratio of the polybutadiene diol to the isocyanate compound, represented by the quotient of the weight of the polybutadiene diol divided by the weight of the isocyanate compound, is in the range from 0.73 to 1.80.

5. The liquid ejection head according to claim 1, wherein the molecule of the second polyol compound has a smaller number of unsaturated carbon-carbon bonds than the molecule of the first polyol compound.

6. The liquid ejection head according to claim 1, wherein the second polyol compound has no polyolefin skeleton.

7. The liquid ejection head according to claim 1, wherein the second polyol compound is a castor oil-based polyol.

8. The liquid ejection head according to claim 1, wherein the isocyanate compound is one of 4,4'-diphenylmethane diisocyanate and polymethylene polyphenyl polyisocyanate.

9. The liquid ejection head according to claim 1, wherein the composition further contains one member selected from the group consisting of an amine compound, an organic tin catalyst, and an acetylacetonate complex of a transition metal.

10. The liquid ejection head according to claim 1, wherein the composition contains a filler selected from the group consisting of silica, carbon black, titanium oxide, kaolin, clay, and calcium carbonate.

11. The liquid ejection head according to claim 10, wherein the filler content in the composition is one-third or less of the total mass of the composition.

12. The liquid ejection head according to claim 1, wherein the plurality of linearly aligned substrates are aligned along a width of the liquid ejection head.

13. The liquid ejection head according to claim 1, further comprising additional gaps between adjacent substrates of the plurality of substrates, the sealing member filling the additional gaps.

14. The liquid ejection head according to claim 1, wherein a proportion by weight of the first polyol compound in the composition is higher than a proportion by weight of the second polyol compound in the composition.

15. The liquid ejection head according to claim 1, wherein the sealing member comprises a matrix-domain structure at a surface of the sealing member, and wherein the first polyol compound forms the domain and the second polyol compound forms the matrix.

16. The liquid ejection head according to claim 1, wherein the first polyol compound and the second polyol compound are the only polyol compounds present in the composition.

17. A method for manufacturing a liquid ejection head including a plurality of linearly aligned substrates, each having an ejection opening through which a liquid is ejected, a recessed member supporting the plurality of linearly aligned substrates, the recessed member having a wall defining a recess in which the plurality of linearly aligned substrates are disposed away from the wall with a gap therebetween, the method comprising:

filling the gap with a composition; and curing the composition to form a sealing member, wherein the composition contains a first polyol compound, an isocyanate compound having an isocyanate group, and a second polyol compound that is more reactive with the isocyanate group than the first polyol compound.

18. The method according to claim 17, wherein the first polyol compound is a polybutadiene diol.

19. The method according to claim 17, wherein the second polyol is a castor oil-based polyol.

20. The method according to claim 17, wherein the filling of the gap is performed by mixing ingredients to prepare the composition and applying the composition into the gap, and wherein the period of time from the mixing to the applying is 30 minutes or less.

* * * * *